United States Patent [19]

Petermann et al.

[11] 3,947,014

[45] Mar. 30, 1976

[54] MACHINE FOR MANUFACTURING ARTICLES OF FOLDED PLASTERBOARD

[75] Inventors: James P. Petermann, Tigard; William E. Dolinar; Stanley V. Ehrlich, both of Portland, all of Oreg.

[73] Assignee: Georgia Pacific Corporation, Portland, Oreg.

[22] Filed: Dec. 16, 1974

[21] Appl. No.: 533,283

Related U.S. Application Data

[62] Division of Ser. No. 459,674, April 10, 1974, Pat. No. 3,885,725.

[52] U.S. Cl. ..... 270/84; 270/21

[51] Int. Cl.[2] ..... B65H 45/18

[58] Field of Search ..... 270/80–85, 270/94, 67, 79, 61, 21; 156/204, 474; 93/84 R, 60; 225/2, 103, 96, 96.5

[56] References Cited

UNITED STATES PATENTS

| | | | |
|---|---|---|---|
| 2,697,970 | 12/1954 | Tipper | 156/474 X |
| 3,752,099 | 8/1973 | Hunter, Jr. et al. | 270/61 R X |
| 3,809,199 | 5/1974 | Bessiere | 93/84 R |

*Primary Examiner*—Robert W. Michell
*Assistant Examiner*—V. Millin
*Attorney, Agent, or Firm*—Klarquist, Sparkman, Campbell, Leigh, Hall & Whinston

[57] ABSTRACT

A machine for manufacturing "sleuters" or other articles of folded plasterboard is described. Sleuters are employed as spacers or risers between stacks of plasterboard or other sheet material and have the advantage that they do not physically mark or discolor such plasterboard, as conventional wooden sleuters sometimes do. Plasterboard remnants are cut to a standard length, and then conveyed intermittently between work stations where they are scored to provide fold lines, folded into two pleated members while simultaneously breaking such members apart from each other, and then stapled. The folding apparatus includes upper and lower folding arms which are moved toward the plasterboard and pivoted to fold and break such board into the two pleated members. The pleated plasterboard members are transmitted from the folding section through a guide to compress them while their layers are stapled together to form the completed sleuter. The stapled sleuters are fed to a transfer means which turns them on one side and slides them into an accumulator to provide a row of sleuters. A complete row of sleuters is dropped onto a stacking mechanism that rotates 90° between each row.

8 Claims, 8 Drawing Figures

MACHINE FOR MANUFACTURING ARTICLES OF FOLDED PLASTERBOARD

This is a division of application Ser. No. 459,674, filed Apr. 10, 1974, now U.S. Pat. No. 3,885,725.

BACKGROUND OF THE INVENTION

The subject matter of the present invention relates generally to the manufacture of articles of folded sheet material, and in particular to machines for manufacturing sleuters or other articles of folded plasterboard. The machine of the present invention makes load spacers or sleuters from plasterboard remnants which are cut into a standard length, scored along fold lines, and transmitted into a folding apparatus which simultaneously folds and breaks the plasterboard member into two separate members having accordian-like pleats. The pleated members are then compressed and stapled to form the completed sleuters. Such sleuters are used as spacers or risers beneath stacks of sheet material, such as gypsum board, for shipping purposes or for storage. The sleuters enable the insertion of the forklifts of lift truck beneath the stack of sheet material for movement thereof and can be used as spacers between stacks sorted into different sized stacks.

Sleuters of folded gypsum boards have the advantage that they do not discolor or physically mark the surface of the plasterboard or other sheet material stacked thereon, and therefore have an advantage over conventional sleuters of wood in this regard. In addition, the machine of the present invention enables plasterboard remnants to be made into commercial articles and thereby greatly reduces waste in plants manufacturing gypsum board sheets.

It has been proposed to fold plasterboard and other sheet material by cutting or scoring it in lines on one side or both sides, as shown in U.S. Pat. No. 2,529,210 of Butler and U.S. Pat. No. 3,646,412 of Sterns et al. Heretofore, folding has been accomplished by moving upper and lower folding members or blades toward each other to provide pleats in a continuous web of sheet material, as shown in U.S. Pat. No. 2,194,344 of Wikander et al, and U.S. Pat. No. 2,670,026 of Unger. However, in these prior apparatus, the folding members or blades are fixed, not pivoted or moved laterally to compress the folds together and do not break the sheet material into two separate members, in the manner of the present invention.

Previous attempts to fold plasterboard as it was moved continuously were unsuccessful due to breakage and resulting jamb-ups. These problems have been overcome in the present invention by providing a conveyor means which moves the plasterboard intermittently between the work stations performing the operations of cutting, scoring, folding and breaking, and stapling. This intermittent movement is provided by a timer operating a clutch connected between the motor shaft and the drive shaft of the conveyor.

The amount of gypsum dust produced during the scoring operation is greatly reduced by operating saw blades providing such scoring at the same speed as the conveyor chain. The plasterboard is accurately positioned at each of the operating stations by stop surfaces on lugs attached to the conveyor chain and the same lugs also act as drive means for moving the plasterboard from one work station to another.

SUMMARY OF THE INVENTION

One object of the present invention is to provide an improved apparatus for folding sheet material which operates in a simple, trouble-free manner.

Another object of the invention is to provide such a folding apparatus which also breaks the sheet material into two separate members during folding by pivoting upper and lower folding arms while they are moved toward such sheet material.

A further object of the present invention is to provide a machine for manufacturing articles of folded sheet material, such as plasterboard, including an automatic conveyor means which intermittently moves the plasterboard members between the work stations of the machine in order to reduce breakage and jamb-ups.

An additional object of the invention is to provide a sleuter manufacturing machine which employs the above-mentioned folding apparatus.

Still another object of the present invention is to provide such a machine which automatically cuts the sheet material into members of standard lengths and then scores the upper and lower surfaces of such member along fold lines before transmitting them to the folding apparatus.

A still further object of the invention is to provide such a machine which automatically fastens the folded plasterboard members together by stapling to form the completed sleuters.

Another object of the invention is to provide such a machine which stacks the completed sleuters in rows, and rotates the stack ninety degrees before adding the next row so that it is arranged perpendicular to the preceding row for more stable storage.

BRIEF DESCRIPTION OF DRAWINGS

Other objects and advantages of the present invention will be apparent from the following detailed description of a preferred embodiment thereof and from the attached drawings of which.

DESCRIPTION OF PREFERRED EMBODIMENT

Figure 1:
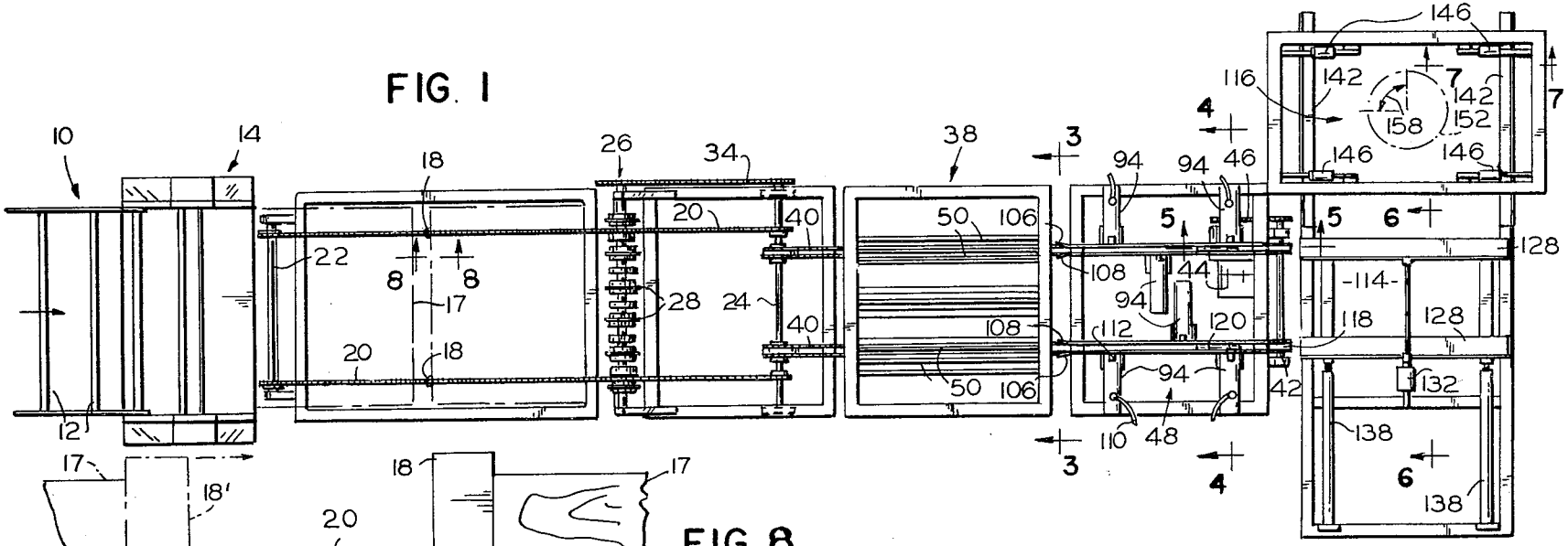
FIG. 1 is a plan view of the sleuter manufacturing machine of the invention.
Figure 2:
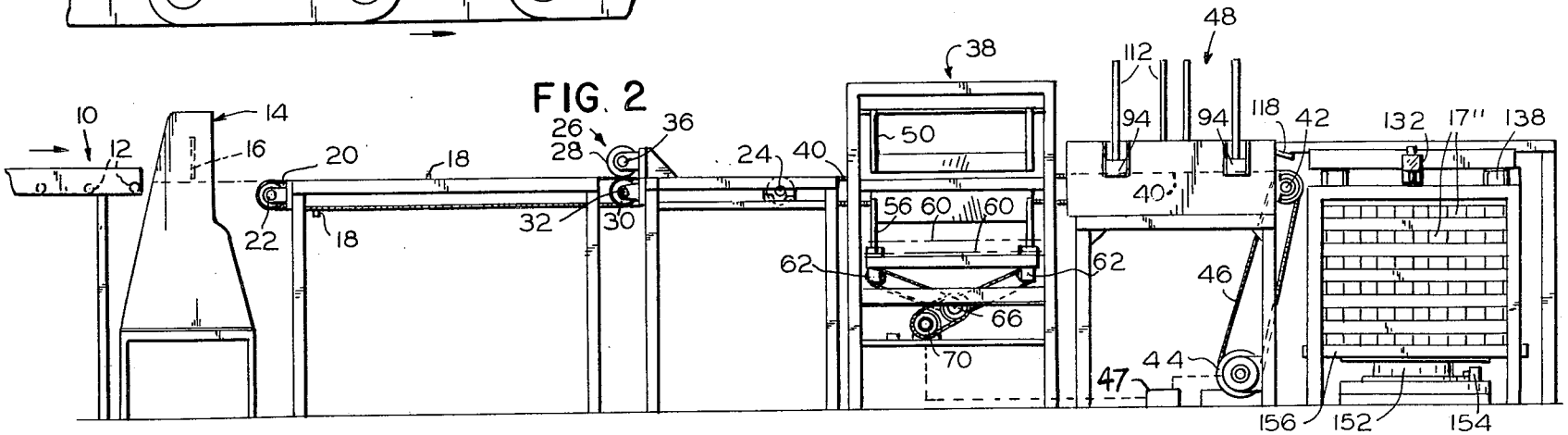
FIG. 2 is a side elevation view of the machine of FIG. 1.

As shown in FIGS. 1 and 2, a machine for manufacturing sleuters or other articles of folded plasterboard in accordance with the present invention includes a conveyor table 10 having a plurality of rollers 12 across which gypsum plasterboard remnants are manually fed to a cutter means 14. The cutter means 14 includes a vertically movable cutter blade 16 which cuts the plasterboard remnants into plasterboard members 17 of a predetermined length when the leading edge of such members engages stop surfaces on the front of lugs 18 attached to two conveyor chains 20 located on the opposite side of the cutter from the conveyor table. The conveyor chains 20 both engage sprockets provided on a shaft 22 at the input end of the conveyor chain and engage other sprockets on a drive shaft 24 provided at the output end of the conveyor chain.

The conveyor chain 20 transmits the plasterboard members 17 through a scoring apparatus 26. The scoring apparatus 26 includes two sets of circular saw blades 28 and 30, respectively, positioned above and below the plasterboard members 17 as they are fed through the scoring apparatus. The lower saw blades 30 are mounted on a common shaft 32 which is driven by the coupling chain 34 connected to a sprocket on the conveyor drive shaft 24 so that the lower saw blades 30 are driven at the same speed as the conveyor chain 20. The upper saw blades 28 are provided on an idler shaft 36 which is unconnected to the conveyor chain. Thus, the upper saw blades 28 are rotated by engagement with the upper surface of the plasterboard members 17 as they pass between the two sets of blades.

The upper saw blades 18 and the lower saw blades 30 are spaced laterally apart approximately four inches to provide longitudinal score lines on the upper and lower surfaces of the plasterboard member 17 in an alternating manner. Thus, two adjacent score lines on the upper surface are separated by a distance of 8 inches and a score line on the lower surface is positioned midway between such two upper score lines to enable folding in a manner hereafter discussed. In addition, there are two aligned score lines extending longitudinally on opposite sides of the plasterboard member 17 in the middle in order to enable such plasterboard member to be broken into two separate members of equal width by a folding apparatus 38 as described hereafter and shown in FIG. 3.

A second pair of conveyor chains 40 is provided for transmitting the scored plasterboard members through the folding means 38. Each of the second conveyor chains 40 is actually a double conveyor chain mounted at its input end on a pair of sprockets attached to the shaft 24 and on another pair of sprockets attached to a main drive shaft 42 at its output end. The main drive shaft 42 is connected to the output shaft of a suitable electric motor 44 by a coupling chain 46, which provides the power for both conveyor chains 40 and 20. Electric motor 44 includes a clutch operated by a mechanical timer 47 to provide intermittent movement to the conveyor chains 20 and 40 so that the plasterboard members 17 are moved intermittently from the cutter means 12 to the scoring means 26 and then from the scoring means to the folding means 38, as well as from such folding means to a stapling means 48. This intermittent movement reduces breakage and prevents jambing. Gypsum dust is also reduced by the previously described scoring operation of the saw blades 26 and 30, rather than using them as saws.

Figure 3:
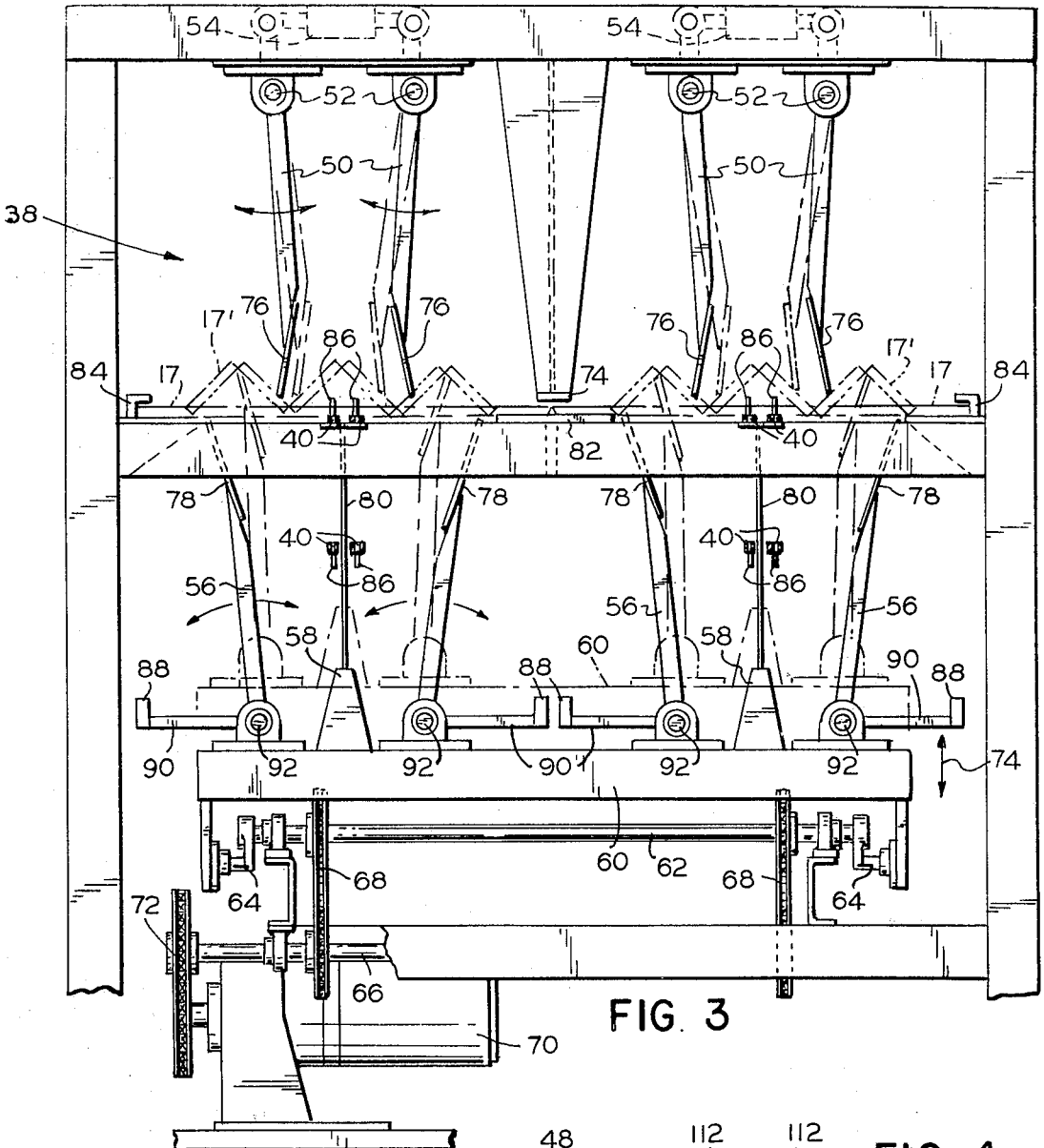
FIG. 3 is an enlarged vertical section view taken along the line 3—3 of FIG. 1 showing the folding apparatus.

As shown in FIG. 3, the folding apparatus 38 includes four upper arms 50 which are mounted in two pairs for pivotal movement on bearings 52. The upper ends of the arms 50 are each connected to the piston rods of pneumatic cylinders 54 which cause the arms of each pair of upper arms 50 to rotate toward each other for folding and to rotate away from each other after the folded articles or sleuters are removed. In addition, the folding means includes two sets of three lower arms including two freely pivoting outer arms 56 and a non-pivoting middle arm 58. The lower arms are mounted on a carriage 60 which is raised and lowered by rotation of a crankshaft 62 whose opposite ends are connected to such carriage by crank arms 64. The crankshaft 62 is coupled to a drive shaft 66 by connector chains 68, and such drive shaft is driven by an electric motor 70. The output shaft of motor 70 is coupled through a clutch to the drive shaft 66 by another coupling chain 72 and associated sprockets provided on such shafts. The clutch of motor 70 is operated by the timer 47 in synchronism with the intermittent movement of the conveyor chain 40. As a result of rotation of the crank shaft 62, the carriage 60 moves vertically up and down in the direction of the double headed arrow 74 in synchronism with the pivoting of the upper arms 50 by cylinders 54 in order to fold the plasterboard member 17 and break it into a pair of pleated members 17'. Thus, the plasterboard is broken apart into two separate members along the pair of aligned score lines at the longitudinal center of such board underneath a fixed anvil member 74, in a manner hereafter described.

The upper arms 50 are provided with blade portions 76 while the lower arms 56 and 58 are provided with similar blade portions 78 and 80 which engage the plasterboard and fold it along the score lines. Upon upward movement of the carriage, each of the blades 76, 78 and 80 engages the plasterboard 17 at a position on the opposite side of such board from and aligned with one of the longitudinal score lines so that continued upward movement of the carriage causes the plasterboard to fold along such score lines. However, in the middle of the plasterboard beneath the anvil 74 and above a corresponding support plate 82, the plasterboard breaks in half because there are two aligned score lines on opposite sides of the plasterboard extending along its center in this area. Thus, as a result of the upward movement of the carriage 60 and the inward pivoting of the upper arms 50 by the cylinders 54, the flat plasterboard 17 held at its sides in a pair of guides 84 is broken into two plasterboard members 17' which are folded into loosely pleated members as shown in FIG. 3. It should be noted that the intermediate arms 58 pass between the two conveyor chains forming each double conveyor chain 40 supporting the plasterboard 17 prior to folding, such plasterboard member being held in a proper longitudinal position by lugs 86 which act as stops in a similar manner to lugs 18 on the conveyor chains 20 of FIG. 1.

Figure 8:
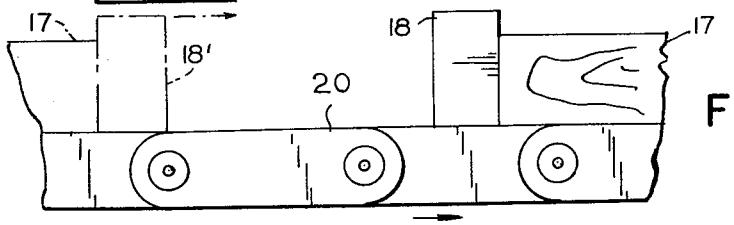
FIG. 8 is an enlarged horizontal section view taken along the line 8—8 of FIG. 8 showing the conveyor chain and associated lug.

As shown in FIG. 8, the left end surface of the lugs 18 on the first conveyor chains 20, in the position 18', shown in phantom lines, engages the front edge of the plasterboard 17 and acts as a stop while such plasterboard is being cut to a predetermined length by the cutter means 14. After cutting, the lug 18 and the chain 20 move forward into the position shown in solid lines where its right end surface engages the rear edge of the previously cut plasterboard member 17 and acts as a driving element. It should be noted that the plasterboard members are manually moved from the cutting apparatus 14 onto the conveyor chains 20 by movement of the next successive plasterboard remnant along the conveyor table 10 into the cutter. However, this could also be done automatically. A similar operation of the lugs 86 on the second conveyor chain 40 properly positions the plasterboard members in the folding apparatus 38 and the fastening apparatus 48.

After folding the plasterboard members into pleated members 17', such pleated members are moved by the conveyor chains 40 and associated lugs 86 from the following apparatus 38 into the fastening apparatus 48 which preferably includes stapling means. Once this is accomplished, the upper folding arms 50 are pivoted back outward by the cylinders 50 and the lower folding arms 56 are caused to pivot outwardly into their normal position by means of counter weights 88 attached by support shafts 90 to the bottom ends of the arms 50 which rotate on bearings 92.

Figure 4:
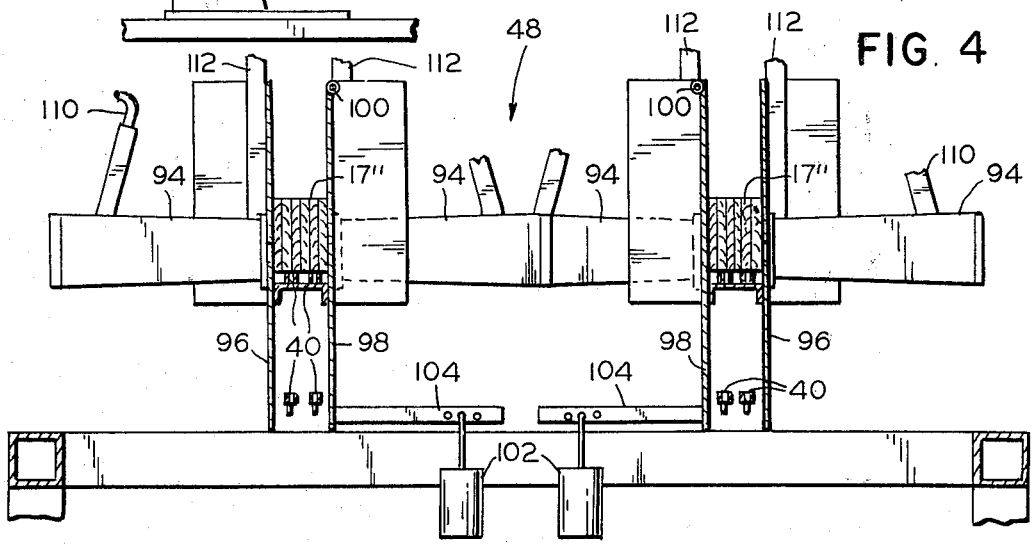
FIG. 4 is an enlarged vertical section view taken along the line 4—4 of FIG. 1 showing the stapling apparatus.

As shown in FIG. 4, the fastening apparatus 48 includes a plurality of pneumatically operated staplers 94 which are mounted on two pairs of pressure plates 96 and 98, provided on opposite sides of the pleated plasterboard members 17' for injecting staples into the opposite sides thereof in order to staple adjacent layers of the members together. The outer pressure plate 96 is fixed while the inner pressure plate 98 is free to pivot about a hinge 100 at its upper edge. The pivoted pressure plate 98 is urged toward the fixed pressure plate 96 by a counterweight 102 adjustably mounted on a support arm 104 attached to the bottom edge of the pivoted pressure plate. The input ends of the pressure plates 96 and 98 are flared to provide end portion 106 and end portion 108, respectively, as shown in FIG. 1. These flared input ends guide the pleated member 17' from the folding apparatus 38 into the fastening apparatus 48 where it is further folded into a tightly compressed bundle prior to stapling. Stapling is accomplished by feeding compressed air through solenoid actuated valves (not shown) into inlet tubes 110 of the staplers. Staples are fed through vertical magazines 112 into the staplers in a conventional manner.

Figure 5:
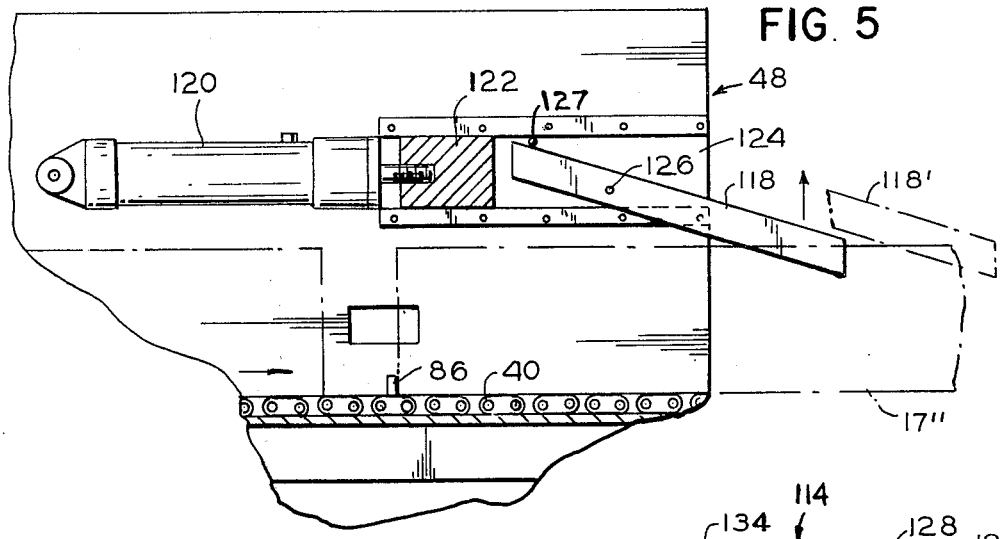
FIG. 5 is an enlarged horizontal section view taken along the line 5—5 of FIG. 1.
Figure 6:
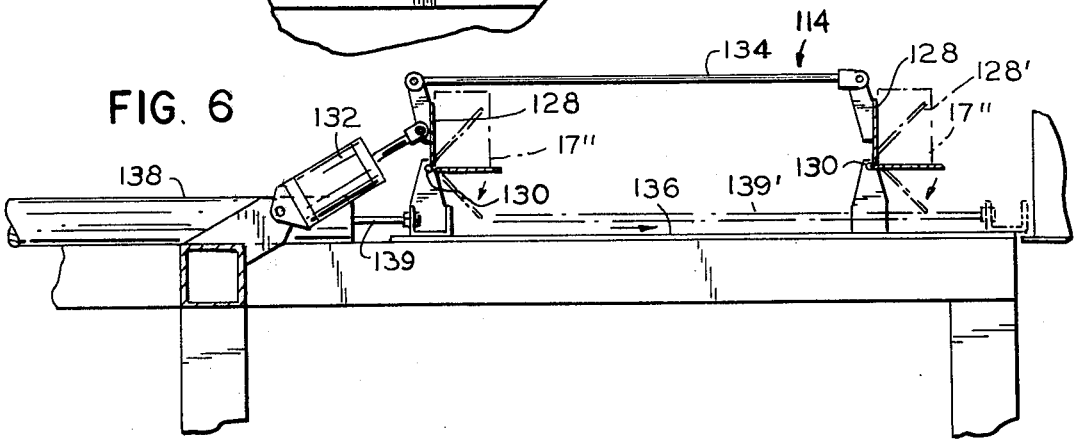
FIG. 6 is an enlarged vertical section view taken along the line 6—6 of FIG. 1 showing the transfer apparatus.

After stapling, the completed sleuters, or spacer members 17', are fed from the fastening apparatus 48 onto a transfer apparatus 114 and from there onto an accumulator and stacking apparatus 116 in a manner hereafter described. As shown in FIG. 5, when the sleuters 17'' reach the end of the second conveyor chain 40, a pair of pivoted dog members 118 engage the rear end of each sleuter and push it onto the transfer apparatus. Thus, a hydraulic cylinder 120 is provided so that its piston 122 engages the rear end of the dog 118 to cause it to move on a carrier member 124 into the dashed line position 118'. The dog is pivotably attached to the carrier member 124 at pivot point 126 and its rear end engages a stop pin 127. As a result, the sleuters slide into a pair of L-shaped trays 128 in the transfer apparatus which are pivotally mounted on support brackets by pivots 130, as shown in FIG. 6. The trays 128 are pivoted into the dashed-line position 128' by a cylinder 132 whose poston rod is directly connected to one tray and is coupled by a coupling rod 134 to the other tray. This tips the sleuters from their vertical stapled position with the pleated layers extending vertically to a horizontal transfer position with their pleated layers extending horizontally and resting on a pair of transfer guides 136. Then, the sleuters are moved by a pair of second cylinders 138 to the right across the transfer guides 136 onto the accumulator and stacking apparatus 116, as shown by the dashed line position 139' of the piston rod of cylinder 138.

Figure 7:
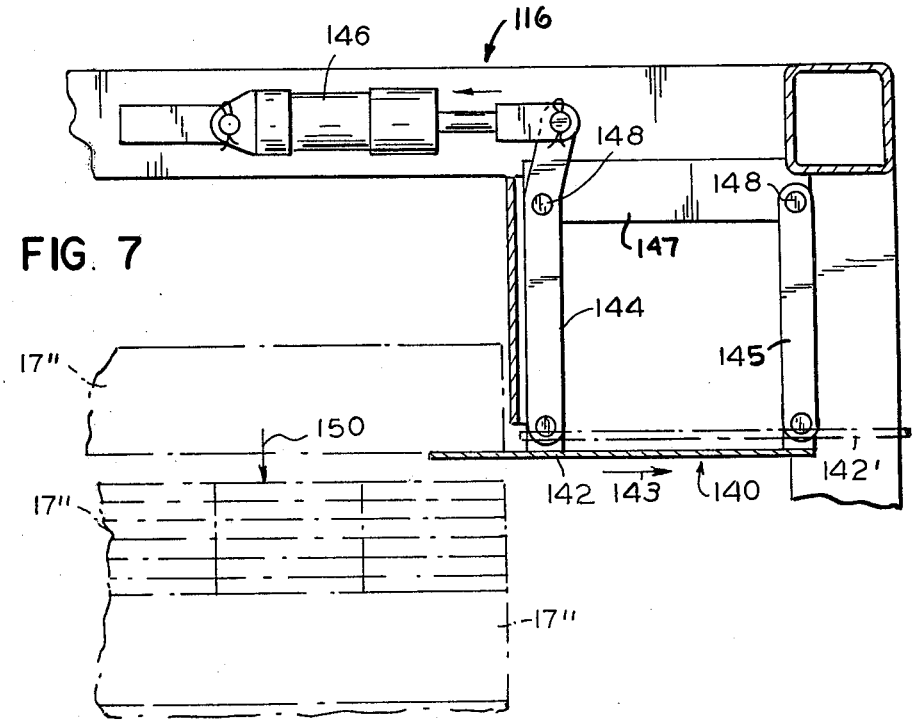
FIG. 7 is an enlarged horizontal section view taken along the line 7—7 of FIG. 1 showing the accumulator and stacking apparatus.

The accumulator and stacking means 116 includes an accumulator device 140 for accumulating an entire row of sleuters 17'' before dropping them onto the top of the stack. The accumulator has a pair of movable support plates 142 whose inner edges overlap the stack and support the ends of the sleuters 17'' in position above the stack and which move in the direction of arrow 143 to drop such sleuters onto the stack. Each accumulator plate 142 is pivotally supported by links 144 and 145 on support member 147 and coupled by link 144 to the piston rods of a pair of actuating cylinders 146. Cylinders 146 cause links 144 and 145 to pivot counterclockwise about fixed pivots 148 which retracts the accumulator plates 142 in direction 143 into the dashed line position 142' and causes the row of sleuters 17'' to drop onto the top of the stack, as shown in FIG. 7 by arrow 150. It should be noted that the cylinders 146 are operated by limit switches when the row of sleuters 17'' is filled so that the first sleuter reaches the end of the accumulator indicating a full row.

As shown in FIGS. 1 and 2, the stacking means 116 includes a turntable 152 which is mounted for rotation back and forth through an arc of 90° upon actuation of a double acting cylinder 154. Thus, turntable 152 resiliently supports a lift truck pallet 156 on which the sleuters 17'' are stacked, urging it upward and rotating back and forth through 90° after each row of sleuters 17'' is dropped onto the stack by the accumulator 140. As a result, alternate rows of sleuters are displaced 90° to provide a crisscrossing of rows which increases the stability of the stack. This reciprocating movement of the turntable 152 is shown by the double headed arrow 158 in FIG. 1.

It will be obvious to those having ordinary skill in the art that many changes can be made in the details of the preferred embodiment of the invention without departing from the spirit of the invention. Therefore, the scope of the invention should only be determined by the following claims.

We claim:

1. Apparatus for folding sheet members, comprising;
a plurality of upper arms;
a plurality of lower arms;
conveyor means for conveying sheet members between said upper and lower arms;
first means for moving said upper and lower arms toward and away from each other; and
second means for pivoting at least some of said arms to fold the sheet member by compressing it between said upper and lower arms into a folded member.

2. Apparatus in accordance with claim 1 which also includes breaker means for pulling said sheet member apart to break the sheet member along a separation line into a pair of separate members which are both folded into folded members.

3. Apparatus in accordance with claim 2 in which the breaker means includes means for pivoting at least two of said arms on opposite sides of the separation line away from each other to break the sheet member simultaneously with said folding.

4. Apparatus in accordance with claim 1 which also includes scoring means for scoring said sheet members to form fold lines along which the sheet members are folded and for feeding the scored members onto said conveyor means.

5. Apparatus in accordance with claim 1 in which the sheet members are made of plasterboard.

6. Apparatus in accordance with claim 1 in which the lower arms include at least one intermediate lower arm which is not pivoted and is mounted between a first pair of pivoted lower arms, and the upper arms includes a first pair of pivoted upper arms positioned on opposite sides of said one intermediate lower arm and between said first pair of lower arms.

7. Apparatus in accordance with claim 6 which also includes a second intermediate lower arm mounted between a second pair of pivoted lower arms, and a second pair of pivoted upper arms on opposite sides of said second intermediate arm and between said second pair of lower arms, and breaker arm positioned between said first and second pairs of arms for breaking the sheet member into two sheet members when said first and second pairs of arms are pivoted toward each other.

8. Apparatus in accordance with claim 1 in which the upper and lower arms each include an elongated folding edge extending longitudinally of the sheet member, the first means includes a powered crank means for moving upward a carriage supporting the lower arms, and the second means includes fluid cylinder means for pivoting said upper arms.

* * * * *